US005868293A

United States Patent [19]

D'Addario et al.

[11] Patent Number: 5,868,293

[45] Date of Patent: Feb. 9, 1999

[54] QUICK RELEASE GUITAR STRAP SYSTEM

[75] Inventors: James D'Addario, Old Westbury; Patrick Zerbo, Huntington, both of N.Y.

[73] Assignee: Innovative Automation, Inc., Farmingdale, N.Y.

[21] Appl. No.: 998,295

[22] Filed: Dec. 24, 1997

[51] Int. Cl.[6] ..... A45F 3/14

[52] U.S. Cl. ..... 224/257; 224/250; 224/579

[58] Field of Search ..... 224/910, 257, 224/258, 250, 578, 579, 580, 572; D3/327, 328; D17/20, 99; 84/327; 24/3.13, 301, 302; 294/159, 160, 149, 150

[56] References Cited

U.S. PATENT DOCUMENTS

| | | | |
|---|---|---|---|
| D. 249,386 | 9/1978 | Zacuto | D56/1 R |
| D. 306,871 | 3/1990 | Bracy | D17/20 |
| D. 335,136 | 4/1993 | McMichael | D17/20 |
| 1,332,088 | 2/1920 | Wagner | 224/150 |
| 2,643,039 | 6/1953 | Sottile | 224/250 |
| 3,664,224 | 5/1972 | Campagna, Jr. | 84/1.01 |
| 3,894,464 | 7/1975 | Brooks | 84/327 |
| 4,138,919 | 2/1979 | Miller | 84/297 R |
| 4,231,586 | 11/1980 | Krause | 24/301 |
| 4,254,901 | 3/1981 | McIntosh | 224/258 |
| 4,271,999 | 6/1981 | Stravitz | 224/257 |
| 4,279,367 | 7/1981 | Jacobs | 224/257 |
| 4,610,476 | 9/1986 | Keiner | 294/149 |
| 4,630,763 | 12/1986 | Friedman | 224/910 |
| 4,762,257 | 8/1988 | Spillers et al. | 224/250 |
| 4,843,943 | 7/1989 | Hoshino | 84/327 |
| 4,858,801 | 8/1989 | Sameniego | 224/264 |
| 4,930,695 | 6/1990 | Thompson et al. | 224/257 |
| 4,993,127 | 2/1991 | Mechem et al. | 24/701 |
| 5,082,155 | 1/1992 | Salvador | 224/150 |
| 5,165,584 | 11/1992 | Meagher et al. | 224/258 |
| 5,332,137 | 7/1994 | Violette | 224/257 |
| 5,388,743 | 2/1995 | Silagy | 224/264 |
| 5,427,291 | 6/1995 | Smith | 224/250 |
| 5,431,320 | 7/1995 | Hash | 224/258 |

OTHER PUBLICATIONS

Letters regarding, pictures of, and advertisements regarding Webb Guitar Strap.

*Primary Examiner*—Allan N. Shoap
*Assistant Examiner*—Gregory M. Vidovich
*Attorney, Agent, or Firm*—Hedman, Gibson & Costigan, P.C.

[57] ABSTRACT

A quick release musical instrument strap attachment device comprising a strap attachment unit which comprises a female receiving quick release portion having base portion and a hollow body portion for receiving and locking a male quick release portion and a first cord having both ends thereof attached to the base portion of the female quick release portion to form a loop and a musical instrument attachment unit comprising a male quick release insertion unit which comprises a base portion and an insertion means adapted for insertion and locking into the hollow body portion of the female receiving quick release portion and a second cord having both ends thereof attached to the base portion of the male receiving quick release portion to form a loop. The strap attachment unit being attachable to a strap and the musical instrument attachment unit being attachable to a musical instrument.

18 Claims, 4 Drawing Sheets

QUICK RELEASE GUITAR STRAP SYSTEM

The present invention relates to a guitar strap system. More particularly, the present invention relates to a quick release guitar strap system. Most particularly, the present invention relates to a guitar strap attachment which can be quickly released by use of a snap means.

BACKGROUND OF THE PRESENT INVENTION

Many players of stringed instruments such as banjos and guitars perform in a standing position and thus require additional means for supporting the instrument in a playing position because it readily becomes tiresome to support the instrument with one's hands while also playing the instrument. Most of these stringed instruments are provided with paired spaced anchor points so that it may be supported by a strap or sling mounted between the anchor points and extending over the player's shoulders and across the player's back.

Exemplary of devices which provide support for stringed instruments are shown in Jacombs, U.S. Pat. No. 4,279,367 (musical instrument harness); Thompson et al., U.S. Pat. No. 4,930,695 (FIG. 8 type harness strap); Hash, U.S. Pat. No. 5,431,320 (suspension strap); Mechem et al., U.S. Pat. No. 4,993,127 (slotted locking attachment for guitar strap); Hoshino, U.S. Pat. No. 4,843,943 (ringed protected strap connection for a guitar); McIntosh, U.S. Pat. No. 4,254,901 (double shouldered guitar strap); Violette, U.S. Pat. No. 5,332,137 (adjustable guitar harness); and Silagy, U.S. Pat. No. 5,338,743 (shoulder pad for decorative guitar strap); among others.

Broadly, a guitar comprises a body and an elongated neck portion extending therefrom. The neck carries a fingerboard over a major portion thereof, and includes a head portion at a second end remote from the body. The strings extend along the elongate neck and are fastened to a suitable supporting structure on the body at one end and to a suitable tuning mechanism on the head portion. See, generally, Miller, U.S. Pat. No. 4,138,919.

On typical guitars, the first of the two anchor points for shoulder straps is located on the body generally in line with the neck on the side of the body opposite that where the neck joins on. Depending on the instrument, and to some extent upon user preference, the second of the two anchor points may be located on the instrument body generally proximate the heel.

Individual players typically have preferred locations of the instrument body and orientations of the instrument neck in which they find it most comfortable to play. For example, a relatively high position of the instrument makes the playing of high notes easier and more relaxing to the player's wrists. On the other hand, a low position may be more comfortable in other respects. Similarly, the angular orientation of the neck is subject to a wide range of player preferences.

However, the traditional method of supporting a guitar with both strap anchors located on the guitar body presents certain disadvantages which render its use less than ideal. For example, the traditional strap support requires the player to provide additional support to the instrument neck. This tends to put additional strain on the fretting hand, and can interfere with proper fretting technique. Depending on the degree of player movement, the problem of slippage with the fretting hand can be relatively acute. When the guitar is worn relatively high on the user's body in order to facilitate the playing of high notes, or relatively low to gain comfort in other respects, a greater tendency of the neck to drop is experienced.

It has therefore become common for players of stringed instruments as described hereinabove to cease use of the second body anchor to tie a piece of string under the strings on the tuning section of the head portion of the neck and tie the string to guitar strap through the hole in the strap which was previously employed for attaching to the anchor.

While this crude solution has helped to reduce strain on the fretting hand, it has caused a variety of other problems. For instance, the bow or knots made with the string are prone to becoming undone during playing, which increases the chance that the guitar may accidentally be dropped. The bows and/or knots can interfere with the tuning strings causing a loss of sound quality. Additionally, many guitarists enjoy playing both with and without the strap. When the guitarist wishes to remove the strap, it can become a struggle to untie the knots in the string going around the guitar headstock. This problem is especially exacerbated when the guitarist is performing on stage and needs to quickly release the strap.

Special mention is made of Brooks, U.S. Pat. No. 3,894,464 which discloses a guitar strap which is includes a means for securely fastening one end of the strap to the head of the guitar neck but is not a quick release connection.

Thus there is a need in the art for the development of a guitar strap attachment system which will overcome the shortcomings of the prior art and will be adaptable for use with current guitar straps.

SUMMARY OF THE PRESENT INVENTION

To this end it is an object of the present invention to provides a means for supporting a guitar.

It is a further object of the present invention to provide a means for supporting a guitar neck thereby freeing the fretting hand from a support role.

It is another object of the present invention to provide a means for adding additional comfort to the guitar player.

It is a still further object to provide a guitar strap which can be quickly released to enable the guitar player to play without a strap.

These and other objects will become known to those skilled in the art in light of the detailed description of the present invention herein.

DETAILED DESCRIPTION OF THE PREFERRED EMBODIMENTS OF THE PRESENT INVENTION

The following description of preferred embodiments of the present invention is provided for illustrative purposes only and should not be construed to limit the claims in any manner whatsoever.

The present invention is particularly suitable for use with acoustic guitars. However, the present invention is applicable to electric guitars and many other types of instruments as well, not only stringed instruments, as long as a slitted strap and at least one instrument anchor is employed in providing a support. The term "guitar" is used herein for the sake of convenience, and its use includes similarly constructed and performing musical instruments such as banjos, electric guitars, acoustic guitars, mandolins and even zithers and the like.

Figure 1:
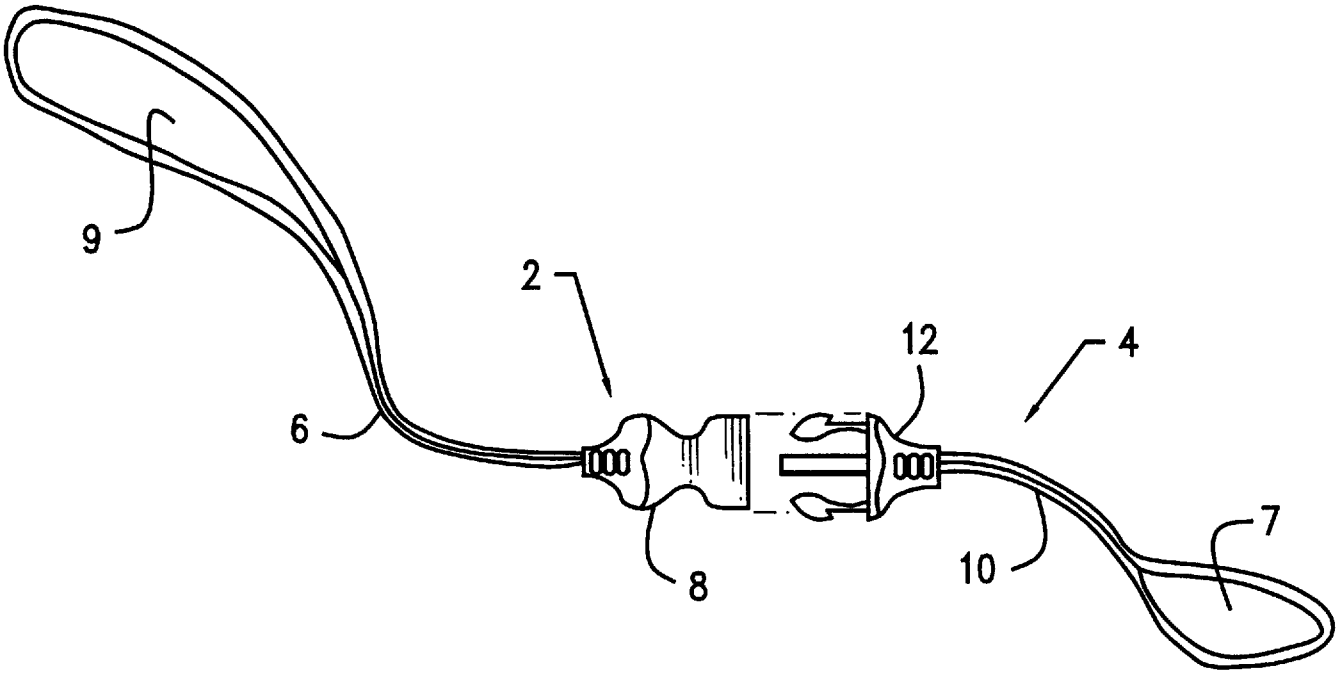
FIG. 1 shows a top view of a device of the present invention.

Referring to FIG. 1, the present invention comprises a guitar support connection comprising two separate units, a strap attachment unit 2 and a guitar attachment unit 4. The strap attachment unit 2 is comprised of a cord 6 and a female receiving quick release unit 8. Similarly, the guitar attachment unit 4 is comprised of a cord 10 and a male insertion quick release unit 12.

The cords 6 and 10 can be of similar or different size. In the embodiment of FIG. 1, cord 6 is longer than cord 10. The cords can be of varied length as long as the length is sufficiently long enough to allow attachment to the guitar strap and guitar and sufficiently short enough so that the entire guitar strap does not become too long to be useful after attachment of the device of the present invention. In a preferred embodiment the cord length may range from about 7 to about 24 inches in length. The cord can be comprised of any relatively sturdy material, such as a nylon or string. Preferably the cord is about 1/16 to about 3/16 inch, more preferably about 1/8 inch, in diameter.

The quick release units 8 and 12 are adapted to easily connect and disconnect. Both units 8 and 12 are preferably comprised of a thermoplastic material and are preferably formed by injection molding, as will be appreciated by those of ordinary skill in the art.

Figure 2:
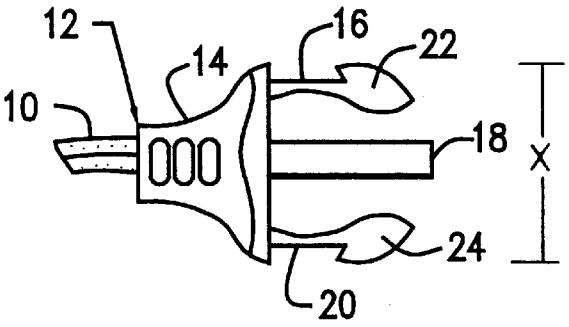
FIG. 2 shows a top view of an insertion portion of a device of the present invention.

Referring to FIG. 2, the male insertion unit 12 has a base 14 and three prongs 16, 18 and 20. Both ends of the cord 10 are attached to the base 14 by any convenient means, such as by an adhesive, or more preferably during the injection molding process in forming the unit 12. In this manner, the cord 10 forms a loop 7 (see FIG. 1).

The two outer prongs 16 and 20 of unit 12 are flexibly connected to the base 14 and are adapted for lockable engagement with the female unit 8, as discussed hereinbelow. Each of the outer prongs 16 and 20 has a knob portion, 22 and 24, respectively, located at the end distal to the base 14. The middle prong 18 functions as a guide during insertion into the female unit 8, as discussed hereinbelow.

Figure 3A:
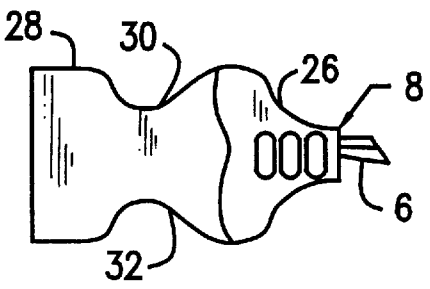
FIG. 3A shows a top view of a receiving portion of a device of the present invention.

Referring to FIG. 3A, the female receiving unit 8 is comprised of a base portion 26 and a receiving portion 28. Both ends of the cord 6 are attached to the base 26 by any convenient means, such as by an adhesive, or more preferably during the injection molding process in forming the unit 8. In this manner the cord 6 forms a loop 5 (see FIG. 1).

Figure 3C:
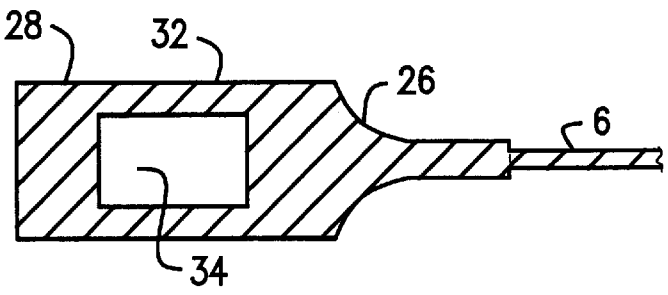
FIG. 3C shows a side view of a receiving portion of a device of the present invention.

The receiving portion 28 is hollow and is provided with indents 30 and 32 on the sides thereof. The indents 30 and 32 are provided with slots 34 (see FIG. 3C) and are suitable for receiving and locking the nubs 22 and 24, respectively, of the male insertion unit 12.

Figure 3B:
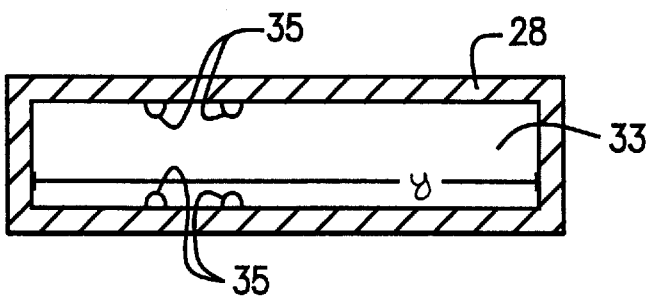
FIG. 3B shows a front view of a receiving portion of a device of the present invention.

It will be appreciated, as best seen in FIG. 3B, that receiving unit 28 is hollow and has an opening 33 in the front thereof. The opening 33 has a width y which is slightly smaller than the width x, from the outside of nub 22 to the outside of nub 20. In this manner, upon insertion of unit 12 into opening 33, the flexible outer prongs 16 and 20 are pushed inward until the insertion unit 12 is inserted a sufficient distance that the nubs 22 and 24 are allowed to spring out through openings 34 (see FIG. 3C) in the indents 30 and 32.

Similarly, the quick release of the mechanism is easily accomplished by pressing inward on nubs 22 and 24 such that the insertion unit 12 may be withdrawn from the receiving unit 8.

The receiving unit 28 is also provided with guide means 35 (see FIG. 3B) which are slightly raised portions to form a track, and are suitable for receiving guide prong 18 from insertion unit 12 in order to facilitate proper alignment between the insertion unit 12 and receiving unit 8.

Figure 4:
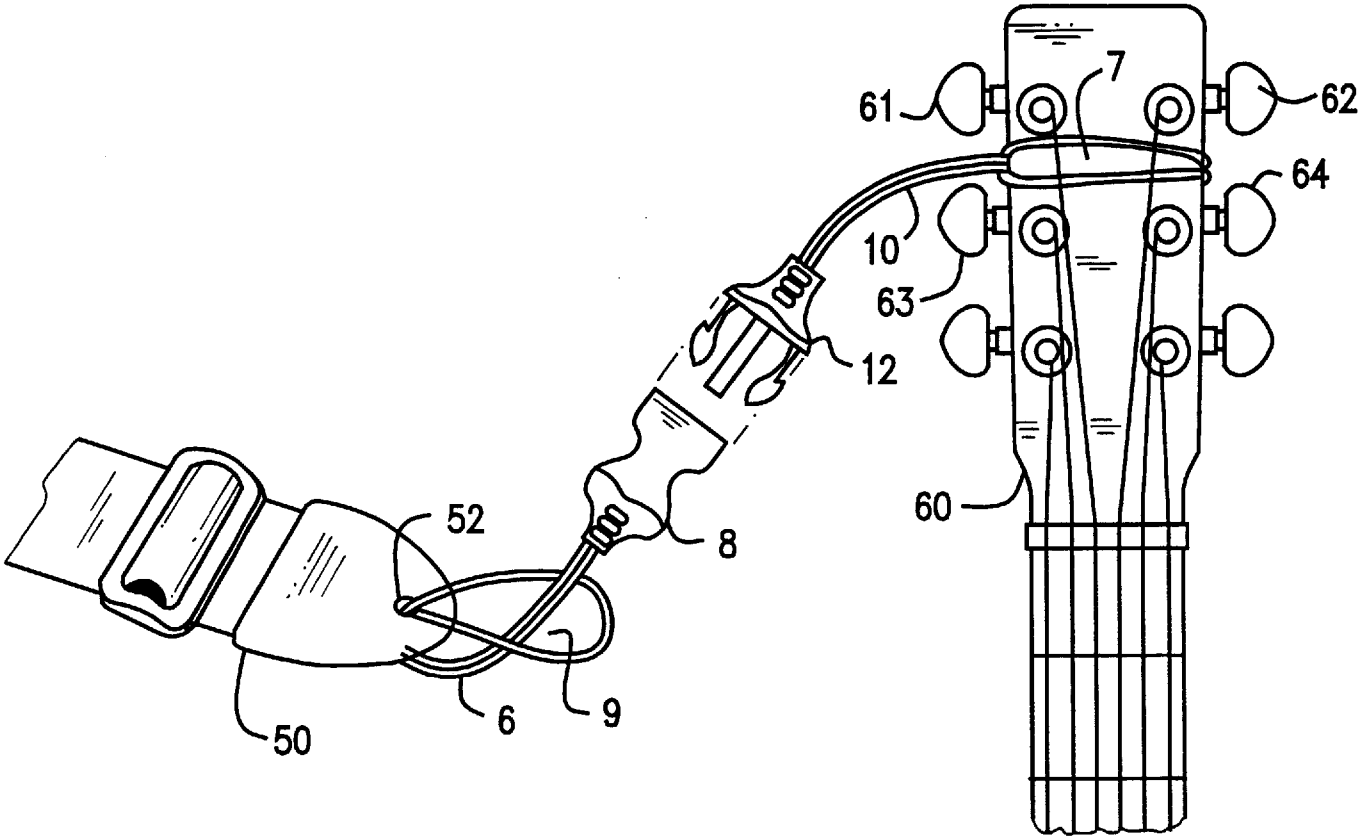
FIG. 4 demonstrates the application of a device of the present invention to a guitar.

Referring to FIG. 4, it can be seen that the cord 6 of receiving unit 8 may be threaded through the hole 52 on strap 50, and the receiving unit passed through the loop 9 formed by cord 6 in order to securely attach the receiving unit to the strap 50. Similarly, the cord 10 of the insertion unit 12 may be passed around the head of the guitar 60 between the last two sets of tuning knobs 61, 62 and 63, 64, and the receiving unit 12 passed through the loop 7 formed by cord 10 in order to tightly secure the insertion unit 12 to the guitar 60.

Figure 5:
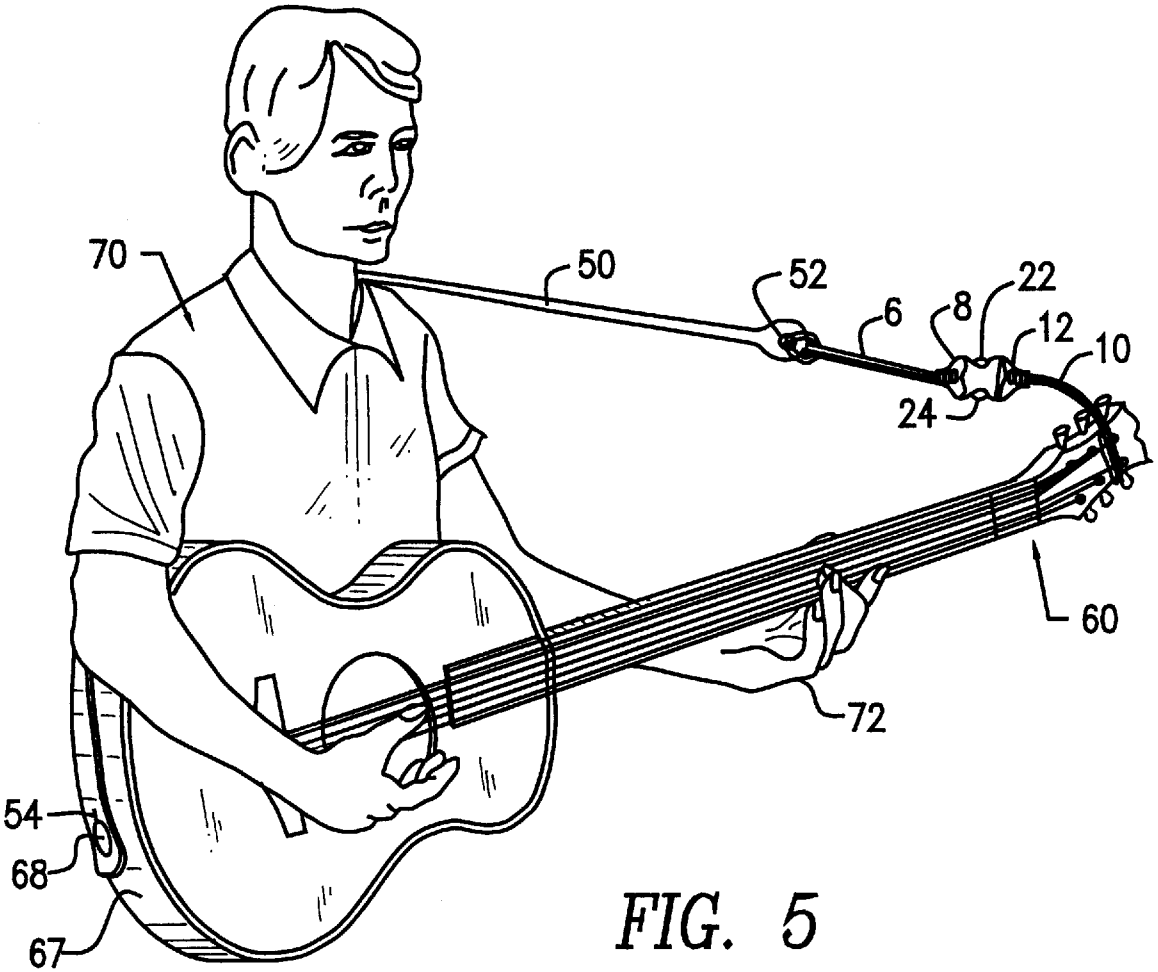
FIG. 5 shows a person playing a guitar employing a device of the present invention.

Referring to FIG. 5, it can be seen that by inserting the insertion unit 12 into the receiving unit 8, a guitar player 70 may wear strap 50 around his or her shoulder and back, where it is then attached to the guitar by a slit 54 on strap 50 and button means 68 on the end 67 of guitar 60. Other attachment means known to those skilled in the art can be employed to attach the strap to the body of the guitar.

Unexpectedly, the use of the device of the present invention provides many significant advantages. The device of the present invention is easy to use and can rapidly be installed by any guitar player. The device of the present invention is very secure and is adaptable for use with almost all of the commercially available guitar straps. The looped through installation insures that there are no bows or knots that can come undone while playing thereby eliminating the possibility that the guitar could be dropped because a string came loose or untied. The device allows for easy removal. Many guitarists play with or without a strap. When the guitarist wishes to remove the strap, the guitarist can simply squeeze the quick release and remove the strap without struggling to untie knots in the string going around the guitar headstock, which could also cause the guitar to become untuned.

The device of the present invention further provides comfort while playing. Because of the extra length provided by the cord and quick release latches, the actual guitar strap webbing, which in most cases is 1½ to 3 inches wide, is not near the guitarist's fretting hand 72 (see FIG. 5) when the guitarist is playing near the headstock of the guitar. This further reduction of interference with the fretting hand, in addition to the freeing up of the fretting hand from a support function, allows for significantly improved facilitation of proper fretting technique.

Many variations of the present invention will suggest themselves to those skilled in the art in light of the above-detailed description. One such variation to those skilled in the art is providing the male insertion quick release unit 12 in connection with the cord 6 and the female receiving quick release unit 8 in connection with the cord 10. This variation is not shown since a detailed drawing is not essential for a proper understanding of the invention in light of the above detailed description. All such obvious modifications are within the full intended scope of the appended claims.

All of the above-referenced patents, patent applications and publications are hereby incorporated by reference.

We claim:

1. A quick release musical instrument strap attachment device comprising:

(a) a strap attachment unit comprising:

(i) a female receiving quick release portion comprising a base portion and a hollow body portion for receiving and locking a male quick release portion, and (ii) a first cord, said first cord having both ends thereof attached to said base portion of said female receiving quick release portion to form a loop; and (b) a musical instrument attachment unit comprising:

(i) a male quick release insertion unit comprising a base portion and an insertion means adapted for insertion and locking into said hollow body portion of said female receiving quick release portion; and (ii) a second cord, said second cord having both ends thereof attached to said base portion of said male receiving quick release portion to form a loop.

2. A quick release musical instrument strap attachment device as defined in claim 1 wherein said insertion means comprises a first and a second prong flexibly attached to the base portion of said male quick release insertion unit, each said prong having a knob portion at the end distal to said base portion.

3. A quick release musical instrument strap attachment device as defined in claim 2 wherein said hollow body portion of said female receiving quick release portion has an opening of a width x which is less than the width from the outside of the knob of the first prong to the outside of the knob of the second prong of said male quick release insertion unit, such that upon insertion of the male insertion means into the body portion of the female receiving quick release portion causes said prongs to be flexed inwardly.

4. A quick release musical instrument strap attachment device as defined in claim 3 wherein said hollow body portion of said female receiving quick release portion further comprises a slot on each side of said hollow body portion suitable for receiving and locking the knobs of the prongs of the male insertion means.

5. A quick release musical instrument strap attachment device as defined in claim 4 wherein said male insertion means is released from said hollow body portion of said female receiving quick release portion by pressing inwardly on said knobs and withdrawing said male insertion means from said hollow body portion of said female receiving quick release portion.

6. A quick release musical instrument strap attachment device as defined in claim 1 wherein said musical instrument is selected from the group consisting of an acoustic guitar, an electric guitar, a mandolin, a banjo and a zither.

7. A quick release musical instrument strap attachment device as defined in claim 6 wherein said musical instrument comprises an acoustic guitar.

8. A quick release musical instrument strap attachment device as defined in claim 7 wherein said strap attachment unit is adapted to be secured to a guitar strap by threading a distal end of said loop of said first cord through a hole on the end of said strap and then directing said female quick release receiving unit through said loop and pulling tightly.

9. A quick release musical instrument strap attachment device as defined in claim 8 wherein said guitar attachment unit is adapted to be secured to said guitar by threading a distal end of the said loop of said second cord under the guitar strings and between the last two sets of tuning knobs, and then directing the male quick release insertion unit through said loop and pulling tightly.

10. A quick release musical instrument strap attachment device comprising:

(a) a strap attachment unit comprising:

(i) a male quick release insertion unit comprising a base portion and an insertion means adapted for insertion and locking into a female receiving quick release hollow body, and (ii) a first cord, said first cord having both ends thereof attached to said base portion of said male quick release insertion unit to form a loop; and (b) a musical instrument attachment unit comprising:

(i) a female receiving quick release portion comprising a base portion and a hollow body portion for receiving and locking said male quick release insertion unit; and (ii) a second cord, said second cord having both ends thereof attached to said base portion of said female receiving quick release portion to form a loop.

11. A quick release musical instrument strap attachment device as defined in claim 10 wherein said insertion means comprises a first and a second prong flexibly attached to the base portion of said male quick release insertion unit, each said prong having a knob portion at the end distal to said base portion.

12. A quick release musical instrument strap attachment device as defined in claim 11 wherein said hollow body portion of said female receiving quick release portion has an opening of width x which is less than the width from the outside of the knob of the first prong to the outside of the knob of the second prong of said male quick release insertion unit, such that upon insertion of the male insertion means into the body portion of the female receiving quick release portion causes said prongs to be flexed inwardly.

13. A quick release musical instrument strap attachment device as defined in claim 12 wherein said hollow body portion of said female receiving quick release portion further comprises a slot on each side of said hollow body portion suitable for receiving and locking the knobs of the prongs of the male insertion means.

14. A quick release musical instrument strap attachment device as defined in claim 13 wherein said male insertion means is released from said hollow body portion of said female receiving quick release portion by pressing inwardly on said knobs and withdrawing said male insertion means from said hollow body portion of said female receiving quick release portion.

15. A quick release musical instrument strap attachment device as defined in claim 10 wherein said musical instrument is selected from the group consisting of an acoustic guitar, an electric guitar, a mandolin, a banjo and a zither.

16. A quick release musical instrument strap attachment device as defined in claim 15 wherein said musical instrument comprises an acoustic guitar.

17. A quick release musical instrument strap attachment device as defined in claim 16 wherein said strap attachment unit is adapted to be secured to a guitar strap by threading a distal end of said loop of said first cord through a hole on the end of said strap and then directing said male quick release insertion unit through said loop and pulling tightly.

18. A quick release musical instrument strap attachment device as defined in claim 17 wherein said guitar attachment unit is adapted to be secured to said guitar by threading a distal end of the said loop of said second cord under the guitar strings and between the last two sets of tuning knobs, and then directing the female quick release receiving unit through said loop and pulling tightly.

* * * * *